US009187193B2

(12) United States Patent
Lancaster, III

(10) Patent No.: US 9,187,193 B2
(45) Date of Patent: Nov. 17, 2015

(54) METHOD AND APPARATUS FOR DISPENSING AN AMOUNT OF FILM RELATIVE TO GIRTH

(75) Inventor: Patrick R. Lancaster, III, Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 774 days.

(21) Appl. No.: 13/429,995

(22) Filed: Mar. 26, 2012

(65) Prior Publication Data

US 2012/0174533 A1 Jul. 12, 2012

Related U.S. Application Data

(60) Continuation of application No. 12/754,472, filed on Apr. 5, 2010, now Pat. No. 8,141,327, which is a division of application No. 11/398,760, filed on Apr. 6, 2006, now Pat. No. 7,707,801.

(60) Provisional application No. 60/669,344, filed on Apr. 8, 2005.

(51) Int. Cl.
*B65B 11/02* (2006.01)
*B65B 11/00* (2006.01)

(52) U.S. Cl.
CPC ..... *B65B 11/025* (2013.01); *B65B 2011/002* (2013.01); *B65B 2210/16* (2013.01); *B65B 2210/18* (2013.01)

(58) Field of Classification Search
CPC ..... B65B 11/025; B65B 2011/002
USPC ..... 53/397, 399, 441, 465, 504, 64, 66, 53/556, 587, 588, 210, 211
IPC ..... B65B 11/02, 11/04
See application file for complete search history.

(56) References Cited

U.S. PATENT DOCUMENTS 2,227,398 A 12/1940 Mohl
3,029,571 A 4/1962 Douthit (Continued)

FOREIGN PATENT DOCUMENTS

DE 3634924 A1 4/1988
DE 4234604 A1 4/1994

(Continued)

OTHER PUBLICATIONS

EPO machine translation of EP 144266 A2, retrieved from http://translationportal.epo.org/ . . . FORMAT=docdb&KIND=A2&LOCALE=en_EP&NUMBER=0144266&OPS=ops.epo.org&ENGINe=google&SRCLANG=fr&TRGLANG=en, Jun. 25, 2012, 4 pages.*

(Continued)

*Primary Examiner* — Stephen F Gerrity
(74) *Attorney, Agent, or Firm* — Middleton Reutlinger

(57) ABSTRACT

A method and apparatus for dispensing a predetermined amount of pre-stretched film based upon load girth. An amount of pre-stretched film to be dispensed for at least a portion of a relative revolution between a film dispenser and a load is determined based upon the girth of the load to be wrapped. Good wrapping performance in terms of load containment (wrap force) and optimum film use may be obtained by dispensing a length of pre-stretched film that is between approximately 100% and approximately 130% of load girth. Once the amount of film to be dispensed per relative revolution is determined, a ratio of final pre-stretch surface speed to relative revolutions (i.e., number of pre-stretch roller revolutions/relative rotation) can be set. Thus, for the at least a portion of a revolution of the rotating ring and dispenser, a predetermined amount of film is dispensed and wrapped around the load.

27 Claims, 6 Drawing Sheets

(56) References Cited

U.S. PATENT DOCUMENTS

| | | | | | |
|---|---|---|---|---|---|
| 3,815,313 | A | | 6/1974 | Heisler | |
| 3,910,005 | A | * | 10/1975 | Thimon et al. | 53/397 |
| 4,152,879 | A | | 5/1979 | Shulman | |
| 4,216,640 | A | | 8/1980 | Kaufman | |
| 4,235,062 | A | | 11/1980 | Lancaster, III et al. | |
| 4,271,657 | A | | 6/1981 | Lancaster, III et al. | |
| 4,300,326 | A | | 11/1981 | Stackhouse | |
| 4,387,548 | A | | 6/1983 | Lancaster et al. | |
| 4,395,255 | A | | 7/1983 | Branecky et al. | |
| 4,418,510 | A | | 12/1983 | Lancaster, III et al. | |
| 4,429,514 | A | * | 2/1984 | Lancaster et al. | 53/556 |
| 4,432,185 | A | | 2/1984 | Geisinger | |
| 4,458,467 | A | | 7/1984 | Shulman et al. | |
| 4,501,105 | A | | 2/1985 | Rogers et al. | |
| 4,503,658 | A | | 3/1985 | Mouser et al. | |
| 4,505,092 | A | | 3/1985 | Bowers et al. | |
| 4,514,955 | A | | 5/1985 | Mouser et al. | |
| 4,524,568 | A | * | 6/1985 | Lancaster et al. | 53/556 |
| 4,590,746 | A | | 5/1986 | Humphrey | |
| 4,628,667 | A | * | 12/1986 | Humphrey et al. | 53/399 |
| 4,676,048 | A | | 6/1987 | Lancaster et al. | |
| 4,693,049 | A | | 9/1987 | Humphrey | |
| 4,712,354 | A | | 12/1987 | Lancaster et al. | |
| 4,736,567 | A | * | 4/1988 | Pienta | 53/587 |
| 4,754,594 | A | | 7/1988 | Lancaster | |
| 4,761,934 | A | | 8/1988 | Lancaster | |
| 4,807,427 | A | | 2/1989 | Casteel et al. | |
| 4,840,006 | A | | 6/1989 | Humphrey | |
| 4,845,920 | A | | 7/1989 | Lancaster | |
| 4,905,451 | A | | 3/1990 | Jaconelli et al. | |
| 4,953,336 | A | | 9/1990 | Lancaster, III et al. | |
| 4,991,381 | A | | 2/1991 | Simons | |
| 5,027,579 | A | * | 7/1991 | Keip | 53/588 |
| 5,040,356 | A | | 8/1991 | Thimon | |
| 5,040,359 | A | | 8/1991 | Thimon | |
| 5,077,956 | A | | 1/1992 | Thimon | |
| 5,107,657 | A | | 4/1992 | Diehl et al. | |
| 5,123,230 | A | | 6/1992 | Upmann | |
| 5,138,817 | A | | 8/1992 | Mowry et al. | |
| 5,163,264 | A | * | 11/1992 | Hannen | 53/64 |
| 5,186,981 | A | | 2/1993 | Shellhamer et al. | |
| 5,195,296 | A | | 3/1993 | Matsumoto | |
| 5,195,297 | A | | 3/1993 | Lancaster et al. | |
| 5,195,301 | A | | 3/1993 | Martin-Cocher et al. | |
| 5,203,136 | A | | 4/1993 | Thimon et al. | |
| 5,203,139 | A | | 4/1993 | Salsburg et al. | |
| 5,216,871 | A | | 6/1993 | Hannen | |
| 5,240,198 | A | | 8/1993 | Dorfel | |
| 5,301,493 | A | | 4/1994 | Chen | |
| 5,311,725 | A | | 5/1994 | Martin et al. | |
| 5,414,979 | A | | 5/1995 | Moore et al. | |
| 5,447,008 | A | | 9/1995 | Martin-Cocher | |
| 5,450,711 | A | | 9/1995 | Martin-Cocher | |
| 5,463,842 | A | | 11/1995 | Lancaster | |
| 5,572,855 | A | | 11/1996 | Reigrut et al. | |
| 5,581,979 | A | * | 12/1996 | Scherer | 53/441 |
| 5,595,042 | A | | 1/1997 | Cappi et al. | |
| 5,634,321 | A | * | 6/1997 | Martin-Cocher et al. | 53/441 |
| 5,653,093 | A | | 8/1997 | Delledonne | |
| 5,671,593 | A | | 9/1997 | Ginestra et al. | |
| 5,765,344 | A | | 6/1998 | Mandeville et al. | |
| 5,768,862 | A | | 6/1998 | Mauro et al. | |
| 5,799,471 | A | | 9/1998 | Chen | |
| 5,836,140 | A | | 11/1998 | Lancaster, III | |
| 5,875,617 | A | | 3/1999 | Scherer | |
| 5,884,453 | A | | 3/1999 | Ramsey et al. | |
| 5,953,888 | A | | 9/1999 | Martin-Cocher et al. | |
| 6,082,081 | A | | 7/2000 | Mucha | |
| 6,195,968 | B1 | | 3/2001 | Marois et al. | |
| 6,253,532 | B1 | | 7/2001 | Orpen | |
| 6,293,074 | B1 | | 9/2001 | Lancaster, III et al. | |
| 6,360,512 | B1 | | 3/2002 | Marois et al. | |
| 6,370,839 | B1 | * | 4/2002 | Nakagawa et al. | 53/64 |
| 6,453,643 | B1 | | 9/2002 | Buscherini et al. | |
| 6,698,161 | B1 | | 3/2004 | Rossi | |
| 6,748,718 | B2 | | 6/2004 | Lancaster, III et al. | |
| 6,826,893 | B2 | | 12/2004 | Cere' | |
| 6,851,252 | B2 | | 2/2005 | Maki-Rahkola et al. | |
| 6,918,229 | B2 | | 7/2005 | Lancaster, III et al. | |
| 7,386,968 | B2 | | 6/2008 | Sperry et al. | |
| 7,707,801 | B2 | | 5/2010 | Lancaster, III | |
| 7,779,607 | B2 | | 8/2010 | Lancaster, III et al. | |
| 2003/0089081 | A1 | * | 5/2003 | Platon | 53/399 |
| 2003/0110737 | A1 | | 6/2003 | Lancaster et al. | |
| 2003/0145563 | A1 | | 8/2003 | Cere' | |
| 2003/0200732 | A1 | | 10/2003 | Maki-Rahkola et al. | |
| 2004/0031238 | A1 | | 2/2004 | Cox | |
| 2005/0044812 | A1 | | 3/2005 | Lancaster et al. | |
| 2005/0115202 | A1 | | 6/2005 | Mertz et al. | |
| 2006/0213155 | A1 | | 9/2006 | Forni et al. | |
| 2006/0248858 | A1 | | 11/2006 | Lancaster | |
| 2006/0254225 | A1 | | 11/2006 | Lancaster et al. | |
| 2006/0289691 | A1 | | 12/2006 | Forni | |
| 2007/0204564 | A1 | | 9/2007 | Lancaster et al. | |
| 2007/0204565 | A1 | | 9/2007 | Lancaster et al. | |
| 2007/0209324 | A1 | | 9/2007 | Lancaster et al. | |
| 2009/0293425 | A1 | | 12/2009 | Carter et al. | |

FOREIGN PATENT DOCUMENTS

| | | | | | |
|---|---|---|---|---|---|
| EP | 0096635 | A2 | | 12/1983 | |
| EP | 144266 | A2 | * | 6/1985 | B65B 11/04 |
| EP | 246659 | A1 | * | 11/1987 | B65B 11/04 |
| EP | 0466980 | A1 | | 1/1992 | |
| EP | 653352 | A1 | * | 5/1995 | B65B 11/04 |
| EP | 0811554 | A1 | | 12/1997 | |
| EP | 1213223 | A1 | | 6/2002 | |
| EP | 1705119 | A1 | | 9/2006 | |
| EP | 1717149 | A1 | | 11/2006 | |
| EP | 1736426 | A2 | | 12/2006 | |
| GB | 2107668 | A | | 5/1983 | |
| JP | 09254913 | A | * | 9/1997 | B65B 11/04 |
| WO | 9822346 | A1 | | 5/1998 | |
| WO | 2004069659 | A1 | | 8/2004 | |
| WO | 2006110596 | A1 | | 10/2006 | |
| WO | 2007071593 | A1 | | 6/2007 | |
| WO | 2007100597 | A2 | | 9/2007 | |
| WO | 2008007189 | A2 | | 1/2008 | |

OTHER PUBLICATIONS

JPO machine translation of JP 09254913 A, retrieved from http://www4.ipdl.inpit.go.jp/Tokujitu/tjsogodbenk.ipdl, Jun. 25, 2012, 11 pages.*

"The Technology Behind a 'No-Tear', 'No-Rip' Film Carriage, and How to Explain it to your Customers," Jan. 21, 2010, downloaded from http://wulftecstretchwrapper.blogspt.com/2010_01_01archive.html on Jan. 7, 2011; 4 pages.

Australian Patent Office; Office Action in Australian Patent Application No. 2006235273 dated Mar. 20, 2012; 3 pages.

European Patent Office; Office Action in European Patent Application No. 06740770.0 dated Feb. 3, 2012; 4 pages.

European Patent Office; Office Action in European Patent Application No. 10184207.8 dated Apr. 2, 2012; 4 pages.

Japanese Patent Office; Office Action in Japanese Patent Application No. 2008-505609 dated Aug. 16, 2011; 5 pages.

* cited by examiner

METHOD AND APPARATUS FOR DISPENSING AN AMOUNT OF FILM RELATIVE TO GIRTH

CROSS-REFERENCE

This application is a continuation of U.S. patent application Ser. No. 12/754,472 filed Apr. 5, 2010, which is a divisional of U.S. patent application Ser. No. 11/398,760 filed Apr. 6, 2006 (issued as U.S. Pat. No. 7,707,801 on May 4, 2010), which claims priority to U.S. Provisional Application Ser. No. 60/669,344 filed Apr. 8, 2005, the disclosures of which are incorporated by reference herein in their entirety.

TECHNICAL FIELD

The present disclosure relates to methods and apparatus for wrapping a load with packaging material, and more particularly, stretch wrapping.

BACKGROUND

Various packaging techniques have been used to build a load of unit products and subsequently wrap them for transportation, storage, containment and stabilization, protection and waterproofing. One system uses stretch wrapping machines to stretch, dispense and wrap stretch packaging material around a load. Stretch wrapping can be performed as an inline, automated packaging technique that dispenses and wraps packaging material in a stretch condition around a load on a pallet to cover and contain the load. Pallet stretch wrapping, whether accomplished by a turntable, rotating arm, vertical rotating ring, or horizontal rotating ring, typically covers the four vertical sides of the load with a stretchable film such as polyethylene film. In each of these arrangements, relative rotation is provided between the load and the packaging material dispenser to wrap packaging material about the sides of the load.

Stretch wrapping machines provide relative rotation between a stretch wrap packaging dispenser and a load either by driving the stretch wrap packaging dispenser around a stationary load or rotating the load on a turntable. Upon relative rotation, packaging material is wrapped on the load. Ring style stretch wrappers generally include a roll of packaging material mounted in a dispenser, which rotates about the load on a ring. Wrapping rings are categorized as vertical rings or horizontal rings. Vertical rings move vertically between an upper and lower position to wrap film around a load. In a vertical ring, as in turntable and rotating wrap arm apparatuses, the four vertical sides of the load are wrapped, along the height of the load. Horizontal rings are stationary and the load moves through the ring, usually on a conveyor, as the dispenser rotates around the load to wrap packaging material around the load. In the horizontal ring, the length of the load is wrapped. As the load moves through the ring and off the conveyor, the packaging material slides off the conveyor (surface supporting the load) and into contact with the load.

Historically, ring style wrappers have suffered from excessive film breaks and limitations on the amount of containment force applied to the load (as determined in part by the amount of pre-stretch used) due to erratic speed changes required to wrap "non-square" loads, such as narrow, tall loads, short, wide loads, and short, narrow loads. The non-square shape of such loads often results in the supply of excess packaging material during the wrapping cycle, during time periods in which the demand rate for packaging material by the load is exceeded by the supply rate of the packaging material by the dispenser. This leads to loosely wrapped loads. In addition, when the demand rate for packaging material by the load is greater than the supply rate of the packaging material by the dispenser, breakage of the packaging material may occur.

When stretch wrapping a typical rectangular load, the demand for packaging material varies, decreasing as the packaging material approaches contact with a corner of the load and increasing after contact with the corner of the load. When wrapping a tall, narrow load or a short load, the variation in the demand rate is even greater than in a typical rectangular load. In vertical rings, high speed rotating arms, and turntable apparatuses, the variation is caused by a difference between the length and the width of the load. In a horizontal ring apparatus, the variation is caused by a difference between the height of the load (distance above the conveyor) and the width of the load.

The amount of force, or pull, that the packaging material exhibits on the load determines how tightly and securely the load is wrapped. Conventionally, this force is controlled by controlling the feed or supply rate of the packaging material dispensed by the packaging material dispenser with respect to the demand rate of packaging material required by the load. Efforts have been made to supply the packaging material at a constant tension or at a supply rate that increases as the demand rate increases and decreases as the demand rate decreases. However, when variations in the demand rate are large, fluctuations between the feed and demand rates result in loose packaging of the load or breakage of the packaging material during wrapping.

The wrap force of all known commercially available pallet stretch wrapping is controlled by sensing changes in demand and attempting to alter supply of film such that relative constant film wrap force is maintained. With the invention of powered pre-stretching devices, sensing force and speed changes was immediately recognized to be critically important. This has been accomplished using feedback mechanisms typically linked to spring loaded dancer bars and electronic load cells. The changing force on the film caused by rotating a rectangular shaped load is transmitted back through the film to some type of sensing device which attempts to vary the speed of the motor driven pre-stretch dispenser to minimize the force change on the film incurred by the changing film demand. The passage of the corner causes the force on the film to increase. This increase force is typically transmitted back to an electronic load cell, spring-loaded dancer interconnected with a sensing means, or by speed change to a torque control device. After the corner is passed the force on the film reduces as the film demand decreases. This force or speed is transmitted back to some device that in turn reduces the film supply to attempt to maintain a relatively constant wrap force.

For example, U.S. Pat. No. 4,418,510 includes an embodiment that sets a pre-stretch roller speed to a reference speed faster or slower than the rotating load. This embodiment experienced no commercial success due the difficulty of practically achieving that process with market acceptable cost and satisfactory wrap performance. Accurately setting and maintaining the reference speeds with the disclosed embodiments proved problematic.

These concepts have proven themselves to be satisfactory for relatively lower rotation speeds where the response time of the sensing device and the physical inertia permit synchronous speed change with corner passage.

With the ever faster wrapping rates demanded by the industry, rotation speeds have increased significantly to a point where the concept of sensing demand change and altering supply speed is no longer effective. The delay of response has been observed to begin to move out of phase with rotation at approximately 20 RPM. The actual response time for the rotating mass of film roll and rollers approximating 100 lbs must shift from accelerate to decelerate eight times per revolution, which at 20 RPM is a shift more than every ½ sec.

Even more significant is the need to minimize the acceleration and deceleration times for these faster cycles. Initial acceleration must pull against the clamped film, which typically cannot stand a high force, especially the high force of rapid acceleration. Thus, acceleration cannot be maintained by the feedback mechanisms described above.

Film dispensers mounted on horizontally rotating rings present additional special issues concerning effectively wrapping at high speeds. All commercially available ring wrappers in use depend upon electrically powered motors to drive the pre-stretch film dispensers. The power for these motors must be transmitted to the rotating ring. This is typically done through electric slip rings mounted to the rotating ring with an electrical pick up finger mounted to the fixed frame. Alternately, others have attempted to charge a battery or run a generator during ring rotation. All of these devices suffer complexity, cost and maintenance issues. But even more importantly they add significant weight to the rotating ring which impacts its ability to accelerate and decelerate rapidly.

Film dispensers mounted on vertically rotating rings have the additional problem of gravity forces added to centrifugal forces of high-speed rotation. High-speed wrappers have therefore required expensive and very heavy two part bearings to support the film dispensers. The presence of the outer race on these bearings has made it possible to provide a belt drive to the pre-stretch dispenser. This drive is taken through a clutch type torque device to deliver the variable demand rate required for wrap force desired.

Due to the problems described above, use of high speed wrapping has been limited to relatively lower wrap forces and pre-stretch levels where the loss of control at high speeds does not produce undesirable film breaks.

SUMMARY OF THE DISCLOSURE

In accordance with the disclosure, a method and apparatus for dispensing a predetermined fixed amount of pre-stretched film relative to load girth is provided.

In one aspect, the presently disclosed embodiments may be directed to an apparatus for stretch wrapping a load. The apparatus may include a non-rotating frame, and a rotatable ring supported by the non-rotating frame. The apparatus may also include a film dispenser having a pre-stretch portion, the film dispenser being mounted on the rotatable ring. The apparatus may further include a non-rotatable ring vertically movable with the rotatable ring relative to the non-rotating frame. The apparatus may also include a drive mechanism configured to rotate the rotatable ring while driving the pre-stretch portion to dispense a pre-determined length of pre-stretched film for at least a portion of a revolution of the rotatable ring.

In another aspect, the presently disclosed embodiments may be directed to an apparatus for stretch wrapping a load. The apparatus may include a rotatable ring. The apparatus may also include a film dispenser having a pre-stretch portion, the film dispenser being mounted on the rotatable ring. The apparatus may further include a belt configured to rotate the rotatable ring, and a drive belt carried on a non-rotatable ring. The drive belt may pass over a pulley connected to the rotatable ring. The second drive belt may drive the pre-stretch portion of the film dispenser to cause a pre-determined length of film to be dispensed for at least a portion of a revolution of the rotatable ring.

In yet another aspect, the presently disclosed embodiments may be directed to a method for stretch wrapping a load. The method may include determining a girth of a load to be wrapped. The method may also include determining a fixed amount of pre-stretched film to be dispensed for at least a portion of a revolution of a film dispenser around the load based on the girth of the load. The method may further include rotating the film dispenser, mounted on a rotatable ring, around the load. The method may further include dispensing the predetermined fixed amount of pre-stretched film during at least a portion of a revolution of the film dispenser around the load to wrap the pre-stretched film around the load.

In yet another aspect, the presently disclosed embodiments may be directed to an apparatus for stretch wrapping a load. The apparatus may include a rotatable ring, and a film dispenser mounted on the ring. The dispenser may include a pre-stretch portion having upstream and downstream pre-stretch rollers. The apparatus may further include a drive mechanism configured to rotate the ring and configured to rotate the downstream pre-stretch roller a pre-determined number of revolutions for at least a portion of a rotation of the ring. The pre-determined number of revolutions of the roller may be selected to cause the dispenser to dispense a fixed length of film for the at least a portion of a revolution of the ring. The fixed length of film may be between approximately 100% and approximately 130% of a girth of the load.

In yet another aspect, the presently disclosed embodiments may be directed to a method of stretch wrapping a load. The method may include providing a film dispenser mounted on a rotatable ring. The film dispenser may also include a pre-stretch portion having upstream and downstream pre-stretch rollers. The method may further include determining a girth of a load to be wrapped, and determining a fixed amount of pre-stretched film to be dispensed for each revolution of a film dispenser around the load based on the girth of the load. The method may further include determining a fixed number of revolutions for the downstream pre-stretch roller for at least a portion of a revolution of the film dispenser around the load based on the fixed amount of pre-stretched film to be dispensed for the at least a portion of a revolution of the film dispenser. The method may further include rotating the film dispenser around the load. The method may further include rotating the downstream pre-stretch roller the fixed number of revolutions during the at least a portion of a revolution of the film dispenser around the load to dispense the fixed amount of pre-stretched film independent of force on the film and independent of the speed of the dispenser.

In yet another aspect, the presently disclosed embodiments may be directed to a method of stretch wrapping a load. The method may include providing a film dispenser mounted on a rotatable ring. The film dispenser may include a pre-stretch portion having upstream and downstream pre-stretch rollers. The method may also include determining a girth of a load to be wrapped. The method may further include determining a fixed amount of pre-stretched film to be dispensed for at least a portion of a revolution of a film dispenser around the load based on the girth of the load. The method may further include rotating the film dispenser around the load, and rotating the downstream pre-stretch roller the fixed number of revolutions during the at least a portion of a revolution of the film dispenser around the load to dispense the fixed amount of pre-stretched film.

Additional objects and advantages will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate one embodiment of the disclosure and together with the description, serve to explain the principles of the disclosure.

DETAILED DESCRIPTION

Figure 1:
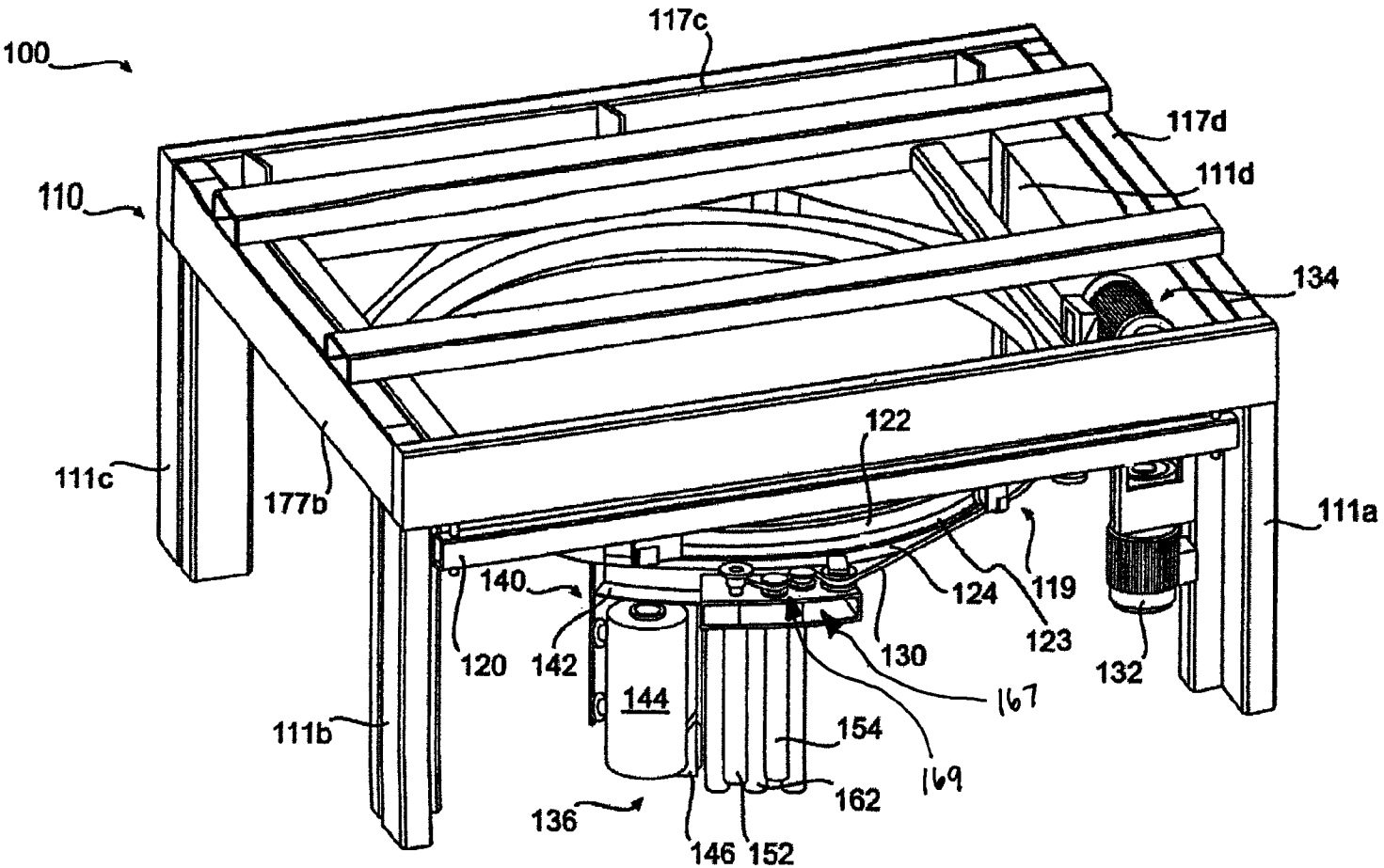
FIG. 1 is an isometric view of an apparatus for wrapping a load according to one aspect of the present disclosure.

Reference will now be made in detail to the present embodiment of the disclosure, an example of which is illustrated in the accompanying drawings. Wherever possible, the same reference numbers will be used throughout the drawings to refer to the same or like parts.

The present disclosure is related to a method and apparatus for dispensing a predetermined fixed amount of pre-stretched film per revolution of a dispenser around a load during a wrapping cycle. The apparatus includes a rotating ring, a film dispenser including a pre-stretch portion, the film dispenser being mounted on the rotating ring, and a drive system for rotating the ring and driving the pre-stretch rollers of the film dispenser.

The fixed amount of pre-stretched film dispensed per revolution of the dispenser is predetermined based upon the girth of the load to be wrapped. The girth (G) of a load is defined as the length (L) of the load plus the width (W) of the load times two (2) or $G=[2\times(L+W)]$. Test results have shown that good wrapping performance in terms of load containment (wrap force) and optimum film use (efficiency) is obtained by dispensing a length of pre-stretched film that is between approximately 100% and approximately 130% of load girth, and preferably between 100% and 120% of load girth. For example, a 40 inch×48 inch load has a girth of (2×(40+48) or 176 inches. To dispense a length of pre-stretched film that is between 100% and 120% of the load girth for every revolution of the dispenser would require dispensing between approximately 176 inches and approximately 211 inches of pre-stretched film. Additional testing has shown that approximately 107% of load girth gives best results. Thus, for the example above, the predetermined amount of pre-stretched film to be dispensed for each revolution of the dispenser would be approximately 188 inches.

The film dispenser travels a known distance around the load each revolution of the ring on which the dispenser travels. The speed at which the dispenser travels is irrelevant, because the same distance is covered by the dispenser during each revolution of the rotating ring regardless of the time it takes to perform the revolution. The ring is belt driven. A drive belt is also used to drive the pre-stretch rollers of the film dispenser. Once the amount of film needed per revolution is established, the next step is to determine how many revolutions of a downstream pre-stretch roller are needed during one revolution of the film dispenser in order to dispense the required amount of pre-stretched film. For example, if approximately 190 inches of film are needed per revolution of the ring/dispenser, one can measure the circumference of the downstream pre-stretch roller, for example 10 inches, and know that each rotation of the downstream pre-stretch roller will dispense 10 inches of pre-stretched film. Therefore, in order to dispenser 190 inches of film during one revolution of the rotating ring and dispenser, the downstream pre-stretch roller must rotate 19 times (190 inches/10 inches). Once the necessary number of revolutions of the downstream pre-stretch roller is known, it is possible to set the sprocket to, for example, 19 pre-stretch roller revolutions per one ring rotation. Thus, the pre-stretched film is dispensed between approximately 100% and approximately 130% of girth/ring revolution and the dispensing is mechanically controlled and precisely selectable by establishing a mechanical ratio of ring drive to final pre-stretch surface speed (e.g., number of pre-stretch roller revolutions/ring rotation). Drive components can be arranged for easy change of the amount of pre-stretch of the film or the percentage of load girth dispensed. Multiple sprockets or a variable transmission could be substituted for sprockets to enable changing the number of pre-stretch roller revolutions/ring quickly. No slip rings, motor, control box, force controls are required. As the rotating ring is driven, that rotational movement drives the pre-stretch rollers through a fixed mechanical connection.

The dispensing of the predetermined fixed amount of pre-stretched film/revolution of the rotating ring and dispenser is independent of wrap force or speed of the ring. It is also independent of load girth shape or placement of the load. The speed of the pre-stretch rollers is thus constant relative to the rotation of the ring. That is, for each revolution of the ring, regardless of the speed of the ring, the pre-stretch roller will complete a constant/fixed number of revolutions. If the ring speed increases, the amount of time it takes for the pre-stretch roller to complete the constant/fixed number of revolutions will decrease, but the same number of revolutions will be completed during one rotation of the ring. Similarly, if the ring speed decreases, the amount of time it takes for the pre-stretch roller to complete the constant/fixed number of revolutions will increase, but the same number of revolutions will be completed during one rotation of the ring.

The rotating ring is powered for very rapid acceleration to over 50 rpm with an acceleration period of one second and a deceleration period of one second. Since the film feed is independent of the rotation speed as described above, there is no extra force on the film during acceleration or excess film during deceleration. If reduced force, below optimum wrapping force, is required during initial startup the ring can be reversed to create slack film at the end of the previous cycle. A one-way clutch 167 may be included to prevent any backlash from film feed while the ring is reversed. The slack film remains well around the first corner of the load until the elasticity of the dispensed film can take it up.

During testing, it was noted that even with the dispensing of a predetermined fixed amount of film per revolution of the rotating ring/dispenser, there was variability in the wrap force on the load. The tests were conducted at approximately 100%, approximately 107%, and approximately 117% of dispensed film length relative to load girth. The illustrated example uses 300% pre-stretch levels, which are the highest levels considered commercially viable. Several films were tested, but 80-gauge film by Tyco is presented for illustration. Other films have similar performance impact with the chosen variables.

At a level of 300% pre-stretch, 107% supply (107% of load girth), with the load off center 3 inches both ways, the wrap force was measured between approximately 3 lb and approximately 24 lb, giving a 21 lb variation in wrap force. When the load was wrapped at 50 RPM there were frequent film breaks. This test was conducted "with no extra film" as will be discussed below.

Figure 4:
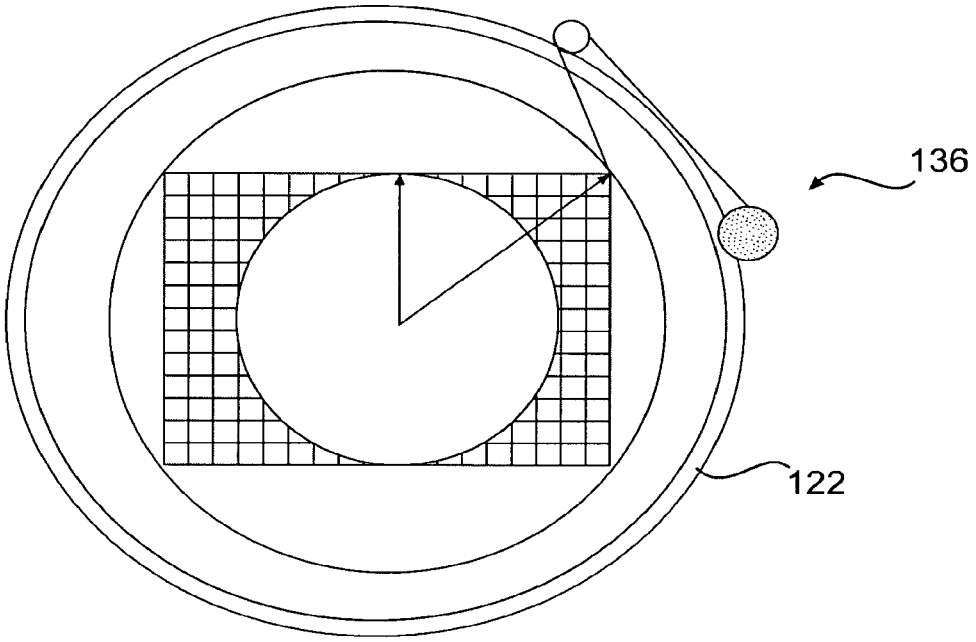
FIG. 4 is a top view of a load being wrapped and illustrates the shortest wrap radius and the longest wrap radius.

The variation in forces seen on the film illustrated above at a constant relative speed can be dampened very significantly by allowing a longer stretch of film between the final pre-stretch roller and the last idle roller mounted to the rotating ring. The extra film provides the additional elasticity in the pre-stretched film to accommodate the passage of a corner of the load or to accommodate offset/off-center loads. It also permits the length of film to the load to always be longer than at least one side of the load. Experimentation and observation of the geometry of the wrap process revealed that an added film length equal to more than the difference between the shortest wrap radius and longest radius of the rectangular load (see FIG. 4) produces significant dampening of the force variation when the load is relatively centered. Extra film length is helpful where the load is positioned off center of the ring for wrapping. A 40×48 load would add approximately 13 inches to the film length. Less than this will be required where the load does not "fill the ring wrap space" since the film from the final idle roller to the load will be more. The optimum length, considering threading and film roll change, has been found to be approximately 29 inches between the final pre-stretch roller and the last idle roller mounted to the rotating ring. It should be noted that the distance from the final rotating idle roller to the load is constantly variable as the corners pass. If the ring is "filled," the passage of a corner of the load may permit only inches of film to the final idle roller.

Testing with the extra film showed the following results:

| % Pre-stretch | % of Load Girth | Load position | Amount of Extra Film | Wrap Force | Wrap Force Variation |
|---|---|---|---|---|---|
| 300% | 107% | off center, 3 inches each way | 0 inches | 3-24 lb | 21 lb |
| 300% | 107% | off center, 3 inches each way | 29 inches | 5-18 lb | 13 lb |
| 300% | 107% | off center, 3 inches each way | 52 inches | 5-16 lb | 11 lb |
| 300% | 107% | off center, 3 inches each way | 88 inches | 7-16 lb | 9 lb |

When the load was wrapped at 50 rpm there were frequent film breaks with no extra film as illustrated in the first example. As Table 1 above shows, the 29 inches of extra film allowed wrapping without breaks even with the load offset 3 inches in both directions.

According to one aspect of the present disclosure, an apparatus 100 for wrapping a load includes a non-rotating frame, a rotatable ring, a film dispenser, and a drive system configured to rotate the rotatable ring and cause to be dispensed a pre-determined constant length of film per revolution of the rotatable ring.

As embodied herein and shown in FIG. 1, the apparatus 100 includes a non-rotating frame 110. Non-rotating frame 110 includes four vertical legs, 111*a*, 111*b*, 111*c*, and 111*d*. The legs 111*a*, 111*b*, 111*c*, and 111*d* of the non-rotating frame 110 may or may not be positioned over a conveyor 113 (see FIGS. 2 and 3) such that a load 115 to be wrapped may be conveyed into a wrapping space defined by the non-rotating frame 110, wrapped, and then conveyed away from the wrapping space. The non-rotating frame 110 also includes a plurality of horizontal supports 117*a*, 117*b*, 117*c*, 117*d* that connect the vertical legs 111*a*, 111*b*, 111*c*, and 111*d* to each other, forming a square or rectangular shape (see FIG. 2). Additional supports may be placed across the square or rectangle formed by the horizontal supports 117*a*, 117*b*, 117*c*, 117*d* (see FIG. 1). In one exemplary embodiment, the non-rotating frame has a footprint of 88 inches by 100 inches. The benefit of this particular footprint is that it allows the apparatus to fit into an enclosed truck for shipment. Prior art devices are generally larger than this and therefore must be disassembled or shipped on a flatbed, which significantly increases shipping costs.

Figure 5:
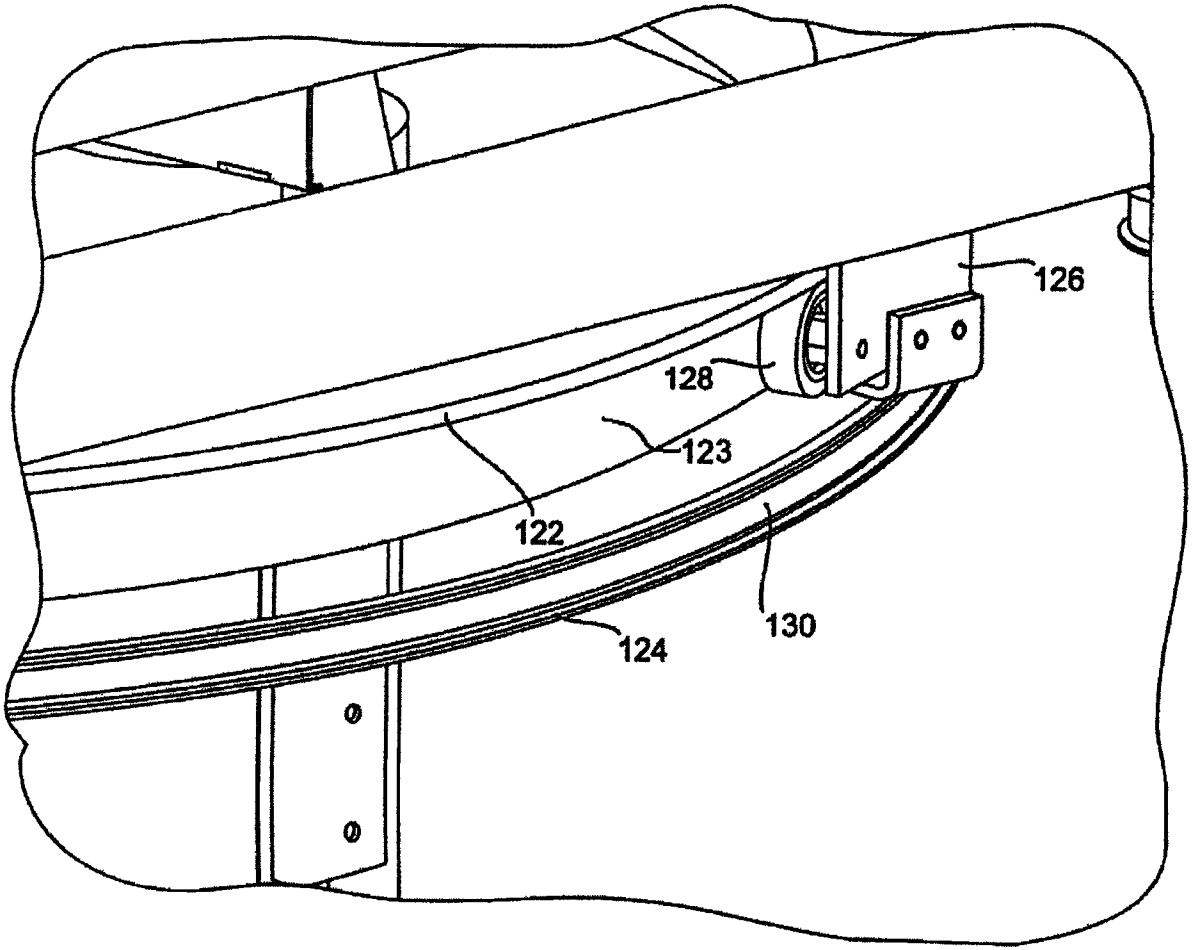
FIG. 5 is an isometric view of a support structure for the rotatable ring of a stretch wrapping apparatus according to one aspect of the present disclosure.

Connected to and movable on non-rotating frame 110 is a vertically movable frame portion 119. As embodied herein and shown in FIGS. 1-3, the vertically movable frame portion 119 includes a support portion 120, a rotatable ring 122, and a fixed (i.e., non-rotatable) ring 124. A plurality of ring supports 126 extend downwardly from the support portion 120 (see FIG. 5). Each ring support 126 may have an L-shape and may comprise one or more pieces of material, such as steel, to form the L-shape. It is possible that the ring supports 126 may have a shape other than an L-shape. Connected to each ring support 126 is a roller or wheel 128. Resting on top of rollers 128 is the rotatable ring 122, such that rotatable ring 122 rides on the rollers 128. Preferably, the rotatable ring 122 is made of a very lightweight material. The lightweight nature of the rotatable ring 122 allows faster movement of the rotatable ring 122, and thus, faster wrapping cycles. In one exemplary embodiment, the rotatable ring 122 has an inner diameter of 80 inches, an outer diameter of 88 inches, and is made of a lightweight composite material. Use of a composite material reduces the weight of the ring by approximately 75% when compared to conventional steel or aluminum rings.

Figure 6:
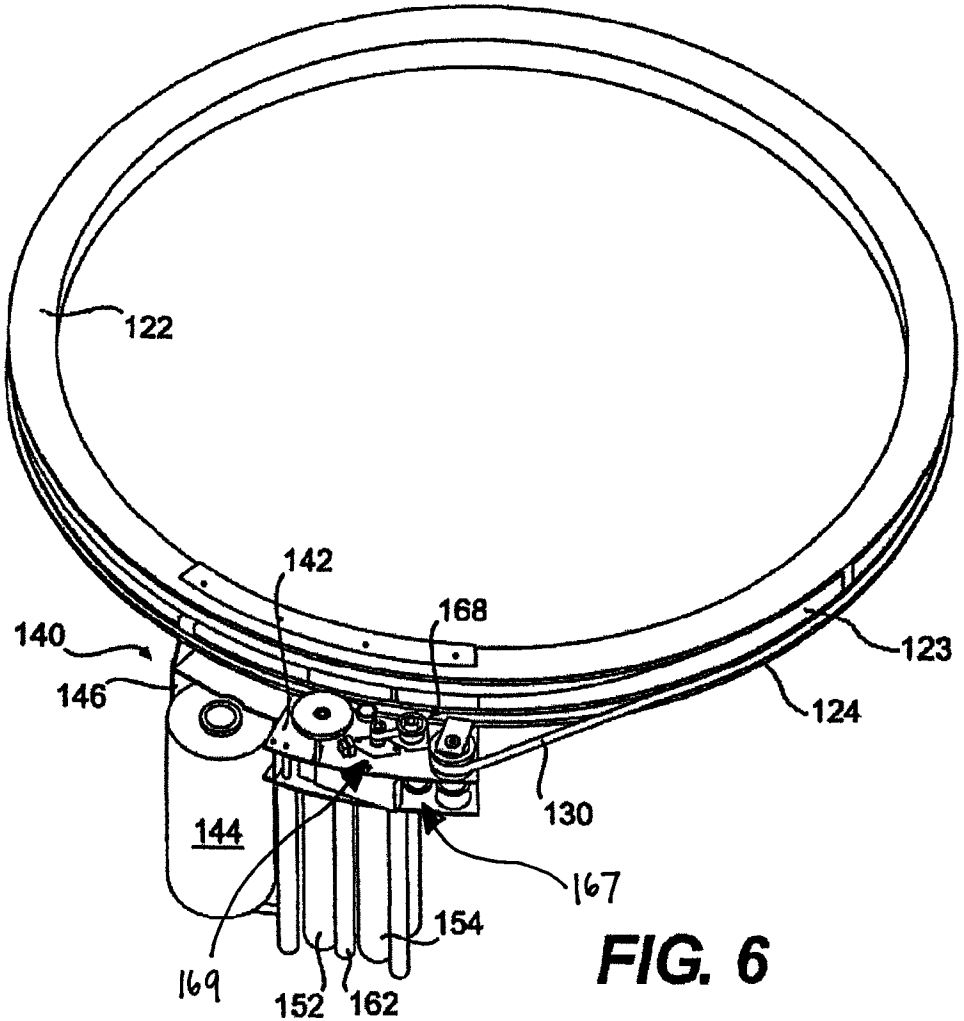
FIG. 6 is an isometric view of a rotating ring, a fixed ring, a drive system and a dispenser of an apparatus according to one aspect of the present disclosure.
Figure 7:
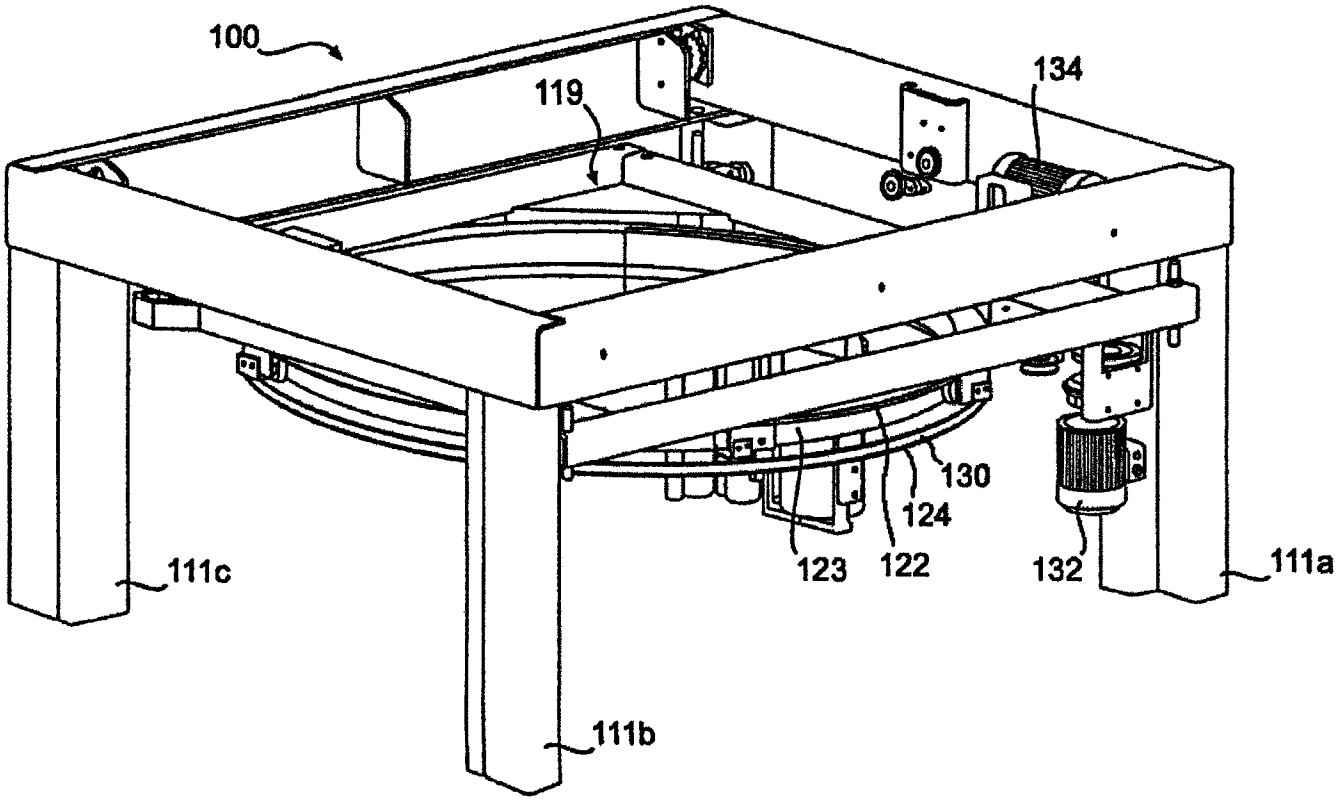
FIG. 7 is an isometric view of an alternative embodiment of an apparatus for wrapping a load according to one aspect of the present disclosure.

Independent of the rotatable ring 122, the fixed ring 124 is positioned below and outside of the rotatable ring 122. Fixed ring 124 is supported by the support portion 120 and carries a drive belt 130 around its outer circumference. The apparatus 100 includes a first motor 132 that serves to drive the rotatable ring 122 using a belt 123 (see FIGS. 1 and 7). The drive belt 130 is picked up by a pulley 168, mounted to the rotatable ring 122 (see FIG. 6). As first motor 132 rotates belt 123, belt 123 in turn rotates rotatable ring 122. In addition, pulley 168 may move together with rotatable ring 122, while drive belt 130 may remain stationary on fixed ring 124. Due to the engagement between pulley 168 and drive belt 130, relative movement between the two may cause pulley 168 to rotate. The rotation of pulley 168 may be used to drive pre-stretch assembly 150. As shown in FIGS. 1 and 7, a second motor 134 raises and lowers the vertically movable frame portion 119 on the non-rotating frame 110.

Figure 2:
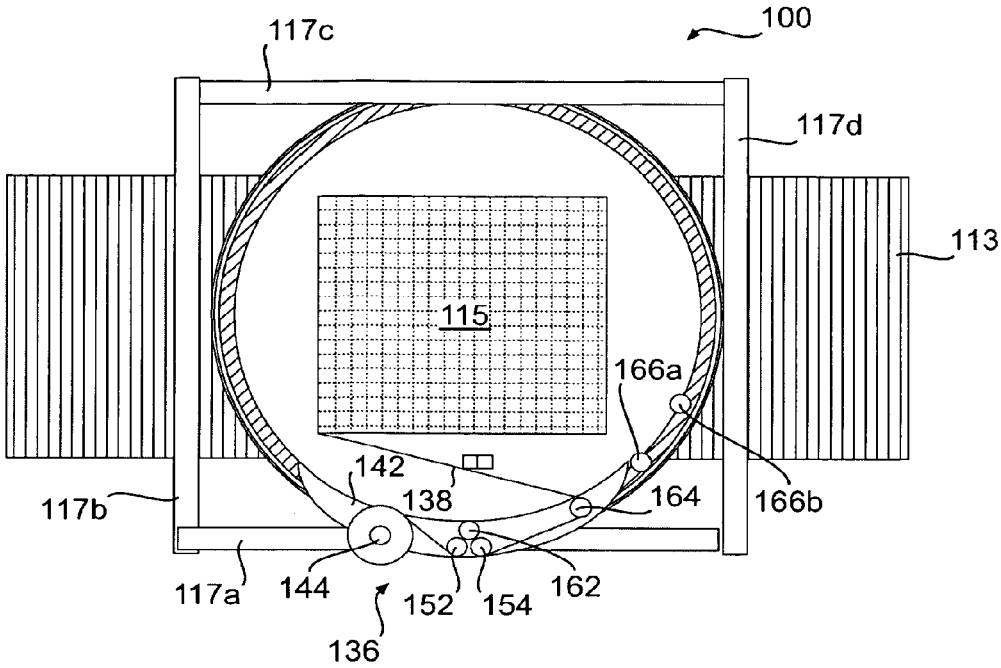
FIG. 2 is a top view of an apparatus for wrapping a load according to one aspect of the present disclosure.

According to one aspect of the present disclosure, a film dispenser is provided. As embodied herein and shown in FIGS. 1-3, the apparatus 100 includes a packaging material dispenser 136. As shown in FIG. 2, the packaging material dispenser 136 dispenses a sheet of packaging material 138 in a web form. The packaging material dispenser 136 includes a roll carriage frame 140 shown in FIGS. 1, 3, and 6. As embodied herein, roll carriage frame 140 includes an upper frame portion or roll carriage drive plate 142. The dispenser 136 supports a roll of packaging material 144 to be dispensed. A film unwind stand 146 is mounted to roll carriage drive plate 142 of the roll carriage frame 140 and extends downwardly from roll carriage drive plate 142. The film unwind stand 146 is constructed to support a roll of film 144 as the packaging material unwinds, moving from the roll of film 144 to a pre-stretch assembly to be described below. The film unwind stand 146 may be bottom-loaded, such that the roll of film 144 may be loaded into the dispenser 136 from below the dispenser 136. A film support portion (not shown) of roll carriage frame 140 may be provided to support the bottom end of the film unwind stand 146.

Preferably, the film dispenser 136 is lightweight, which in combination with the lightweight rotatable ring 122, allows faster movement of the rotatable ring 122 and thus faster wrapping cycles. By using the first motor 132 and the drive belt 130 to drive a pre-stretch assembly 150, it is possible to eliminate the conventional motor that drives the dispenser 136 as well the conventional control box, greatly reducing the weight of the dispenser 136.

In an exemplary embodiment, stretch wrap packaging material is used, however, various other packaging materials such as netting, strapping, banding, or tape can be used as well. As used herein, the terms "packaging material," "film," "web," and "film web" are interchangeable.

Figure 3:
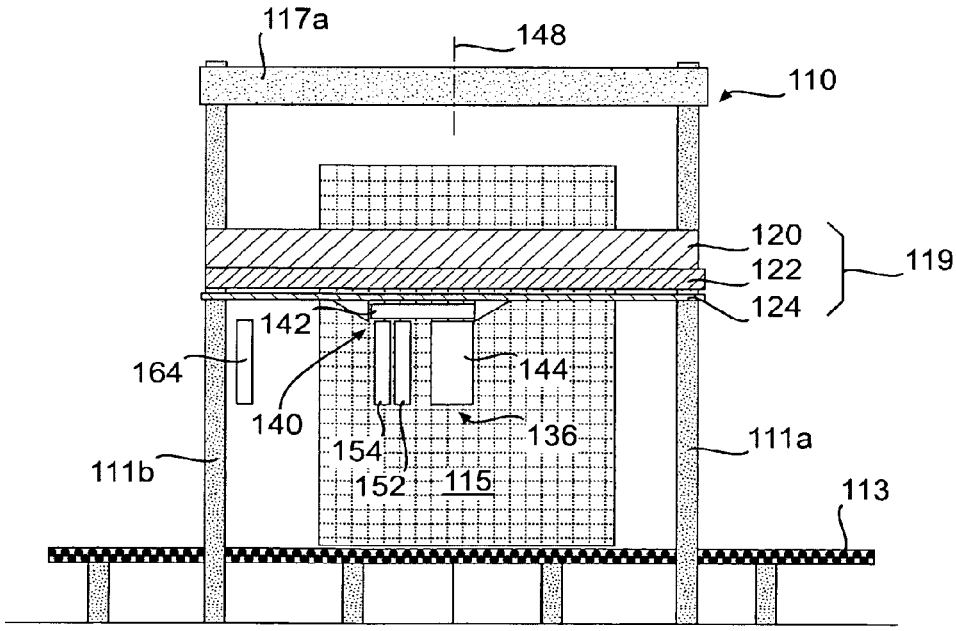
FIG. 3 is a side view of the apparatus of FIG. 2.

According to one aspect of the present disclosure, the dispenser 136 is mounted on rotatable ring 122, which is supported by the vertically moveable frame portion 119. The dispenser 136 rotates about a vertical axis 148, shown in FIG. 3, as the vertically moveable frame portion 119 moves up and down the non-rotating frame 110 to spirally wrap the packaging material 138 about the load 115. The load 115 can be manually placed in the wrapping area or conveyed into the wrapping area by the conveyor 113. As shown in FIGS. 1 and 3, the film dispenser 136 is mounted underneath and outboard of the rotatable ring 122, enabling maximum wrapping space.

As shown in FIGS. 1-3, film dispenser 136 includes the pre-stretch assembly 150. The pre-stretch assembly 150 includes a first upstream pre-stretch roller 152 and a second downstream pre-stretch roller 154. "Upstream" and "downstream," as used in this application, are intended to define the direction of movement relative to the flow of the packaging material 138 from the dispenser 136. Thus, since the packaging material 138 flows from the dispenser 136, movement toward the dispenser 136 and against the flow of packaging material 138 from the dispenser 136 is defined as "upstream" and movement away from the dispenser 136 and with the flow of packaging material 138 from the dispenser 136 is defined as "downstream."

The first upstream pre-stretch roller 152 and the second downstream pre-stretch roller 154 may have different sized sprockets so that the surface movement of the first upstream pre-stretch roller 152 is at least 40% slower than the second downstream pre-stretch roller 154. The sprockets may be sized depending on the amount of film elongation desired. Thus, the surface movement of the first upstream pre-stretch roller 152 can be about 40%, 75%, 200%, or 300% slower than the surface movement of the second downstream pre-stretch roller 154 to obtain pre-stretching of 40%, 75%, 200%, or 300%. While pre-stretching normally ranges from 40% to 300%, excellent results have been obtained when narrower ranges of pre-stretching are required such as stretching the material 40% to 75%, 75% to 200%, 200% to 300%, and at least 100%. In certain instances, pre-stretching has been successful at over 300% of stretch. The pre-stretch rollers 152 and 154 are connected by a drive chain or belt.

In one exemplary embodiment, each pre-stretch roller 152, 154 is preferably the same size, and each may have, for example, an outer diameter of approximately 2.5 inches. Each roller should have a sufficient length to carry a twenty (20) inch wide web of film 138 along its working length. In one exemplary embodiment, rollers used for conventional conveyors were used to form the pre-stretch rollers 152, 154. Each roller 152, 154 is mounted on a shaft, for example, a hex shaft. In one embodiment, bearings for supporting a shaft, such as a hex shaft, are press-fit or welded into each end of each roller 152, 154, and the shaft is placed therethrough, such that the shaft is centrally and axially mounted through the length of each roller 152, 154. As discussed above, a sprocket may be mounted/attached to an outer surface of each roller 152, 154. The rollers 152, 154 are thus connected to each other through chains to a sprocket idle shaft with the pre-stretch sprockets selected for the desired pre-stretch level. The pre-stretch assembly 150 maintains the surface speed of the downstream pre-stretch roller 154 at a speed which is faster than the speed of the upstream pre-stretch roller 152 to stretch the stretch wrap packaging material 138 between the pre-stretch rollers 152 and 154.

As embodied herein and shown in FIGS. 1 and 2, the pre-stretch assembly 150 may include an intermediate idle roller 162 positionable between the upstream and downstream pre-stretch rollers 152 and 154. The intermediate idle roller 162 may be the same diameter as or smaller in diameter than the pre-stretch rollers. Preferably, intermediate idle roller 162 is uncoated. In one exemplary embodiment, intermediate idle roller 162 is an idler roller hingedly connected to the upper frame portion 142 of roller carriage frame 140. Intermediate idle roller 162 is also a cantilevered roller and it may not be connected to an additional structure and is not supported at its base. Although not physically connected at its base or to a base support, intermediate idle roller 162 may nest in the U-shaped guard 160 that connects the first and second pre-stretch rollers 152, 154. Preferably the intermediate idle roller 162 is aligned to provide a pinching action on the upstream roller 152 as disclosed in U.S. Pat. No. 5,414,979, the entire disclosure of which is incorporated herein by reference.

According to another aspect of the present disclosure, the film dispenser 136 may include a second idle roller 164 positioned downstream of the second downstream pre-stretch roller 154. As described above, spacing the second idle roller 164 downstream of the last pre-stretch roller 154 provides a length of extra film between the final pre-stretch roller and the last idle roller mounted to the rotating ring. The extra film provides the additional elasticity in the pre-stretched film to accommodate the passage of a corner of the load or to accommodate offset/off-center loads. It also permits the length of film to the load to always be longer than at least one side of the load. Preferably, the second idle roller 164 is positioned to provide an extra film length equal to more than the difference between the shortest wrap radius and longest radius of the rectangular load (see FIG. 4). Additionally, as shown in FIG. 2, rotatable ring 122 may include additional rollers attached to its top surface. The additional rollers 166*a*, 166*b* are provided for a longer film path where irregular loads or placements are an issue.

According to another aspect of the present disclosure, the apparatus 100 may be provided with a belted film clamping and cutting apparatus and disclosed in U.S. Pat. No. 4,761,934, the entire disclosure of which is incorporated herein.

In operation, load 115 is manually placed in the wrapping area or is conveyed into the wrapping area by the conveyor 113. The girth of the load 115 is determined and a fixed amount of film to be dispensed for each revolution of the dispenser 136 and rotatable ring 122 is determined based on the load girth. The fixed amount of film to be dispensed may be between approximately 100% and approximately 130% of the load girth, and preferably is between approximately 100% and approximately 120% of load girth, and most preferably is approximately 107% of load girth. Once the fixed amount of film to be dispensed/revolution is known, the mechanical connection 169 that allows the drive belt 130 to drive the downstream pre-stretch roller 154 is adjusted to provide a desired ratio of ring drive to pre-stretch surface speed.

A leading end of the film 138 then is attached to the load 115, and the motor 132 drives the rotatable ring 122. The drive belt 130 is picked up by the pulley 168 mounted to the rotatable ring 122, as seen in FIG. 6. As the rotatable ring 122 is driven, it drives through a fixed mechanical connection with the pre-stretch rollers 152, 154, causing elongation of the film 138 and the dispensing of the predetermined fixed amount of pre-stretched film for each revolution of the rotatable ring 122 and the dispenser 136. The fixed mechanical connection may include one or more linking components, such as, for example, a chain or belt, linking pulley 168 to pre-stretch rollers 152, 154, such that rotating pulley 168 causes rotation of pre-stretch rollers 152, 154. The dispenser 136 rotates about a vertical axis 148 as the vertically moveable frame portion 119 moves up and down the non-rotating frame 110 to spirally wrap the packaging material 138 about the load 115.

Other embodiments will be apparent to those skilled in the art from consideration of the specification and practice of the disclosure. It is intended that the specification and examples be considered as exemplary only, with a true scope and spirit of the disclosure being indicated by the following claims.

What is claimed is:

1. An apparatus for stretch wrapping a load, comprising:

a film dispenser having a pre-stretch portion; and a drive mechanism providing relative rotation between the film dispenser and the load;

the pre-stretch portion dispensing a pre-determined length of pre-stretched film for at least a portion of a revolution of the film dispenser relative to the load, the pre-determined length of pre-stretched film based upon the girth of the load;

wherein the pre-determined length of pre-stretched film dispensed for the at least a portion of a revolution of the film dispenser relative to the load is independent of the speed of relative rotation.

2. The apparatus of claim 1, wherein the pre-determined length of pre-stretched film is independent of wrap force.

3. The apparatus of claim 1, wherein the drive mechanism drives the pre-stretch portion to dispense the pre-determined length of pre-stretched film for the at least a portion of a revolution of the film dispenser relative to the load as the speed of relative rotation increases.

4. The apparatus of claim 1, wherein the drive mechanism drives the pre-stretch portion to dispense the pre-determined length of pre-stretched film for the at least a portion of a revolution of the film dispenser relative to the load as the speed of relative rotation decreases.

5. The apparatus of claim 1, further comprising a mechanical connection between the drive mechanism and the film dispenser, the mechanical connection driving the pre-stretch portion to dispense film.

6. An apparatus for wrapping a load with packaging material, the apparatus comprising:

a packaging material dispenser;

a rotation assembly configured to provide relative rotation between the packaging material dispenser and the load; and a control cooperating with the rotation assembly and the packaging material dispenser to dispense a length of packaging material therefrom at a ratio based on a girth of the load and independent of feedback from the packaging material, for at least a portion of the relative rotation.

7. A method for wrapping a load, comprising:

determining an amount of film to be dispensed for at least a portion of a revolution of a film dispenser relative to the load;

providing relative rotation between the film dispenser and the load; and dispensing the predetermined amount of film during the at least a portion of the revolution of the film dispenser relative to the load to wrap the film around the load.

8. The method of claim 7, wherein determining an amount of film to be dispensed includes selecting a percent value indicative of the amount of film to be dispensed.

9. The method of claim 8, wherein selecting a percent value includes selecting a percentage of a girth of the load.

10. The method of claim 9, wherein selecting a percentage of the girth of the load includes determining the girth of the load.

11. The method of claim 10, wherein determining the girth of the load includes measuring at least one of a length L of the load or a width W of the load.

12. The method of claim 11, wherein the girth of the load is determined using the formula $G=[(L+W)\times 2]$, wherein G is the girth.

13. The method of claim 9, wherein selecting a percent value indicative of an amount of film to be dispensed for at least a portion of a revolution of a film dispenser includes selecting an amount of film that is between approximately 100 percent and approximately 130 percent of the girth of the load.

14. The method of claim 13, wherein selecting a percent value indicative of an amount of film to be dispensed includes selecting an amount of film that is between approximately 100 percent and approximately 120 percent of the girth of the load.

15. The method of claim 14, wherein selecting a percent value indicative of an amount of film to be dispensed includes selecting an amount of film that is between approximately 100 percent and approximately 110 percent of the girth of the load.

16. The method of claim 8, wherein dispensing the predetermined amount of film at the selected percent value is maintained for the at least a portion the wrapping cycle.

17. The method of claim 7, wherein dispensing the predetermined amount of film is independent of a speed of rotation of the film dispenser relative to the load.

18. The method of claim 7, wherein providing relative rotation between the film dispenser and the load includes driving the film dispenser into rotation using a drive mechanism.

19. The method of claim 18, wherein dispensing the predetermined amount of film includes rotating a film dispensing roller in the film dispenser with the drive mechanism.

20. The method of claim 19, further including providing an idle roller downstream from the film dispensing roller for engaging the film.

21. The method of claim 20, further including separating the idle roller and the film dispensing roller by a distance equal to a difference between a shortest wrap radius and a longest wrap radius of the load.

22. The method of claim 19, further including establishing a ratio of drive mechanism operation to film dispensing roller speed.

23. The method of claim 22, wherein establishing a ratio includes adjusting the ratio using a variable transmission.

24. The method of claim 22, wherein establishing a ratio includes coupling the drive mechanism and the film dispensing roller using a fixed mechanical connection.

25. The method of claim 22, wherein establishing a ratio includes setting a fixed number of revolutions for the film dispensing roller for the portion of the revolution of the film dispenser relative to the load based on a percent value.

26. The method of claim 25, further including rotating the film dispensing roller the fixed number of revolutions during the portion of the revolution of the film dispenser around the load to dispense the amount of film independent of force on the film and independent of the speed of the film dispenser.

27. The method of claim 7, wherein dispensing the predetermined amount of film includes rotating a downstream pre-stretch roller of a pre-stretch portion of the film dispenser a predetermined number of revolutions during the at least a portion of the revolution of the film dispenser relative to the load.

* * * * *